United States Patent [19]

Wilkinson et al.

[11] 4,315,129

[45] Feb. 9, 1982

[54] MOBILE APPARATUS FOR WELDING STUDS TO RAIL BASE PLATES

[75] Inventors: Harold C. Wilkinson, Medford; Angelo M. D'Attoma, Moorestown, both of N.J.; Stephen W. Walker, Louisville, Ky.

[73] Assignee: Omark Industries, Inc., Portland, Oreg.

[21] Appl. No.: 85,016

[22] Filed: Oct. 15, 1979

[51] Int. Cl.[3] ..... B23K 9/20; E01B 29/16

[52] U.S. Cl. ..... 219/99; 104/16; 104/17 R; 219/98; 219/124.34

[58] Field of Search ..... 219/98, 99, 124.34; 104/1 R, 16, 17 R

[56] References Cited

U.S. PATENT DOCUMENTS

| | | | |
|---|---|---|---|
| 3,579,260 | 5/1971 | Logan | 219/98 |
| 3,588,418 | 6/1971 | Chiffey | 219/98 |
| 3,762,333 | 10/1973 | Theurer et al. | 104/17 R |

*Primary Examiner*—C. C. Shaw

*Attorney, Agent, or Firm*—Duffield & Lehrer

[57] ABSTRACT

Mobile apparatus for, on site, welding of rail retaining clip studs to existing railroad rail plates which includes a railway car assembly having wheel and axle assemblies and propulsion means to move the railway car assembly along the railway tracks. The railway car assembly further includes two carriage assemblies each of which carries two welding gun assemblies which project downwardly upon each side of the rail plate. The carriage assembly includes carriage actuator means for moving the carriage assembly both longitudinally and transversely of the rail plate to position the welding gun assemblies. A position and sensing control means is provided which includes a rail plate sensor which first senses the position of a rail plate to stop the railway car assembly and properly position the welding gun assembies with respect to the rail plate longitudinally thereof. The position sensing and control means further includes a rail web sensor which senses and positions the welding gun assemblies transversely of the rail in proper position.

15 Claims, 7 Drawing Figures

MOBILE APPARATUS FOR WELDING STUDS TO RAIL BASE PLATES

BACKGROUND OF INVENTION

The present invention applies to methods and apparatus for welding studs to railroad rail plates to which spring clip devices are attached to hold the rails in place and, more particularly, to such apparatus which is mobile and operates on the rails when in place to provide a retrofit for existing rails.

Railways have, for years, conventionally utilized wooden cross ties upon which are positioned rail plates under the railroad ties. The rail plates are anchored to the railroad ties by means of the conventional railway spikes. Additionally, the railway rail is secured to the railway plate by means of conventional railroad spikes.

The continual and repeated side loads upon the rails by the cars passing over the rails as well as other factors such as ice buildup under the rail flange ultimately cause the railway spikes to work upwardly from the rail tie. As this occurs, movement is permitted between the railway rail and the rail plate. This movement has the obvious disadvantage of permitting the rail to upset causing derailments. Additionally, the loose railroad spikes cannot control rail creep—i.e. longitudinal movement of the rail with respect to the rail plates.

In the past, various different forms of securing the rail to the rail plate have been tried such as threaded anchor bolts screwed into the railway tie and cooperating with spring clip members bearing against the rail flange. Additionally, other devices have been tried such as concrete ties into which there are cast anchor or securing devices which likewise cooperate with spring members to maintain the rail flange in engagement with the rail plate. In this latter case, replacement of the entire ties under an existing railway is expensive and thus, impractical.

The assignee of the present patent application, the KSM Division of Omark Industries, Inc., 301 New Albany Road, Moorestown, N.J. 08057, has developed a new spring clip rail retaining system. In the Omark system, a headed stud is welded to the rail plate on each side of the railroad rail. A spring retaining clip is engaged with the headed stud with a portion of the retaining clip bearing upon the flange or heal of the railroad rail. The stud-spring clip assembly provides flexure of the spring clip or a resiliency between the rail and the rail plate to overcome the foregoing described difficulties of railroad spikes.

One of the very significant advantages of the Omark system is that the studs and retaining clips can be a retrofit system to existing railways. The configuration of the studs is such that they can be welded between existing railway spikes on a given rail plate without the necessity of removing the railway spikes or replacing the rail plates and ties.

Apparatus for welding large headed studs to metallic base members such as railway plates has been known for considerable time. However, such apparatus is either a stationary machine located in a plant or a portable hand held welding gun. In the environment of welding studs to a railway rail plate, certain environmental difficulties are encountered. First, there must be four such studs welded to each of two rail plates for a given railway tie. The virtual number of studs which thus must be welded for a given section of railway track is enormous and the need for some apparatus to carry the studs and to automatically weld them becomes evident. Additionally, the supporting apparatus such as the welding generator and controllers must be capable of being moved along the rail conveniently.

A first consideration would be to mount the stud welding apparatus upon a railway car and move along the rails and weld two studs each side of each rail for a given railway tie simultaneously or substantially simultaneously and thus, move to the next rail and so on. However, there are many practical difficulties encountered in such an approach by reason of the physical variations in the railway system.

One significant variation is that the railroad ties are very often not absolutely perpendicular to the railroad rails. Thus, to align the welding guns to weld one set of headed studs for one railway plate will not necessarily align the other pair of welding gun assemblies in proper longitudinal relationship to the railway plate under the opposite rail. Likewise, variations in gage created by wear and displacement of the railway plates will create variations in the positioning of the railway assemblies for transverse welding position to the rail plate on a tie by tie basis.

A further yet difficulty encountered is obstructions which occur along the railway. One form of obstruction which may create interference conditions with the welding gun assemblies is the utilization of angle bars or couplings applied to the joints of the rails. Other forms of obstructions which give difficulties are railway spikes which have worked upwardly out of the tie to such a height as to cause an intereference.

A further yet variation which can create difficulty in an on site welding situation is the vertical distance between a given railway car and a rail as the railway car moves along the track. Deflection of the railroad rails upon loose ties, wear of the rail and the like will create a vertically varying distance betwen a welding gun and the rail which must be compensated for.

OBJECTS AND SUMMARY OF INVENTION

It is an object of the present invention to provide mobile apparatus for welding studs to rail plates for use with rail retaining clips which will automatically weld the studs to the rail plates on a sequential tie by tie basis.

It is a further object of the present invention to provide automatic positioning of the welding gun assemblies to compensate for variation in longitudinal positioning and gage positioning of the rail plates.

It is also a further object of the present invention to provide means for sensing obstructions incurred along the railway to protect the welding equipment.

In accordance with the present invention, a railway car assembly is provided which includes axle means and propulsion means for mounting the car assembly upon the railway and for moving along the railway at a predetermined and controlled speed. Two carriage assemblies are provided, one for each rail of the railway system. The carriage assemblies each support two welding gun assemblies which extend from the carriage assembly upon an angle down to the railway plate upon which the headed studs are to be welded.

Each carriage assembly includes carriage actuator means which will permit the carriage assembly and its associated welding gun assemblies to be moved in both the direction longitudinally of the rail plate as well as transversely thereof to position the welding gun assemblies properly with respect to the rail plate.

Each carriage assembly further carries a position sensing and control assembly which, connected through sensor support arms, carries a rail plate sensor positioned on one side of the rail and a rail web sensor on the opposite side. As the railway car assembly moves from one cross tie to the next, one of the rail plate sensors chosen as a master sensor senses the appearance of the next rail plate and stops the railway car in the proper position of the welding gun assembly with the rail plate. Thereafter, the other rail plate sensor then operates through a welding gun assembly control means to move the opposite carriage longitudinally in a direction to bring the welding guns carried by that assembly into proper longitudinal welding position for the opposite rail plate. Following this, both rail web sensors then operate through the welding gun assembly control means to transversely position the welding guns with respect to the two rail plates.

Following sensing and positioning of the welding guns with respect to the two rail plates, the sensors are moved out of position and the welding gun assembly moved into position whereupon the studs are welded to the rail plate. Thereafter, the welding gun assemblies are retracted and the process repeated.

An obstruction sensor is positioned beneath the railway car assembly adjacent the inside web of both rails to sense obstructions. The obstruction sensor is in advance of the welding gun assemblies and the position sensing and control assemblies. Upon the encountering of an obstruction, the obstruction sensor operates through control means to stop the railway car assembly before damage can occur to the welding gun assemblies and the position sensing and control assemblies.

Other objects and advantages of the present invention will become apparent to those skilled in the art from the detailed description thereof which follows taken in conjunction with the drawings.

DETAILED DESCRIPTION OF INVENTION

Figure 1:
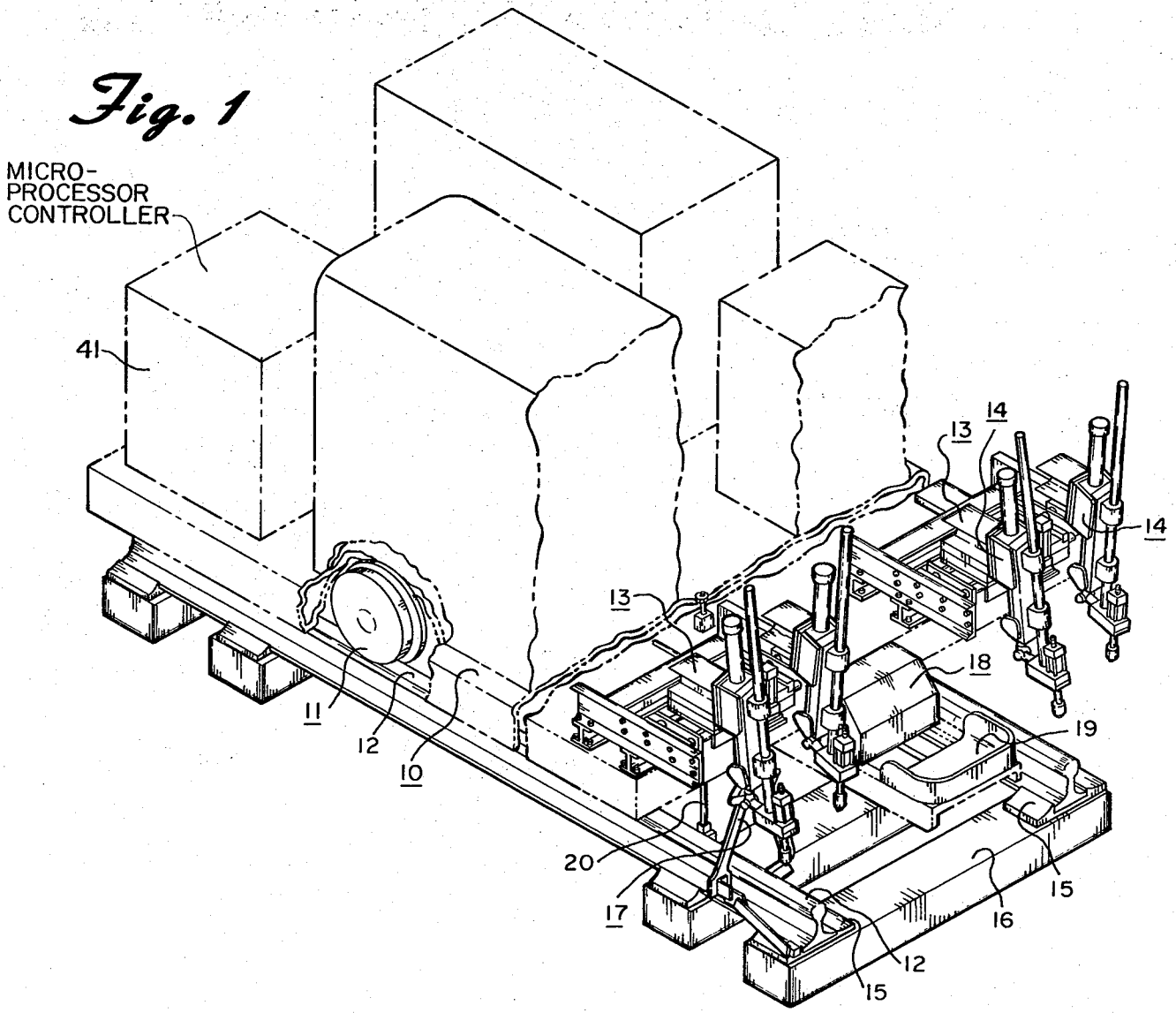
FIG. 1 is a partial perspective view of the railway car assembly and included equipment of the present invention.

In accordance with the present invention and as shown in FIG. 1 of the drawings, a railway car assembly 10 is provided. The railway car assembly includes axle assemblies 11 (one shown) which support the railway car assembly 10 upon the rails 12 of the railroad.

The railway car assembly includes propulsion means (not shown) for driving the railway car assembly along the railway at predetermined speeds. The propulsion means includes two speeds, a first which is capable of moving the railway car assembly along the rail at a high speed of approximately 17 miles per hour. The propulsion means also includes a low speed mode of approximately 2 feet per minute which is utilized during the welding operation to be described hereinafter.

The railway car assembly also includes supporting apparatus which is shown in phantom such as a welding generator, hydraulic pumps, standard 110 generating means and other related control modules and propulsion systems all of which are necessary to the welding operation but do not form a part of the invention.

The railway car assembly includes two carriage assemblies 13 carried upon a rear portion of the railway car assembly 10. The operation of the carriage assembly 13 will be described in more detail hereinafter.

Figure 6:
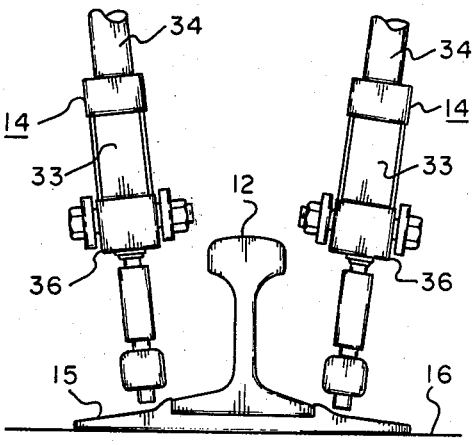
FIG. 6 is an end view of the lower portion of the welding gun assemblies in position for welding to a rail plate.

Two welding gun assemblies 14 are carried by each of the carriage assemblies 13 and are adapted to extend downwardly into welding position with the rail plates 15 positioned upon cross ties 16 as partially illustrated in FIG. 6.

Returning to FIG. 1, each carriage assembly 13 further includes a position and sensing control assembly 17 which extends downwardly from the carriage assembly 13 into the region of the rail plate 15 and web of the rail 12 to properly position the welding gun assemblies as hereinafter described.

The railway car assembly further includes a control console 18 and an operator's seat 19 from which the railway car assembly and welding gun assemblies can be operated as well as the studs and arc shields loaded into the welding gun assemblies.

Still referring to FIG. 1, an obstruction sensor 20 is positioned on the inside web of each rail and extends downwardly from and is supported by the railway car assembly in advance of the welding gun assemblies and position sensing and control assemblies. The obstruction sensor provides a determination of the presence of an obstruction and is in a position to stop the railway car assembly before damage occurs to the welding gun assemblies or position sensing and control assemblies.

Figure 2:
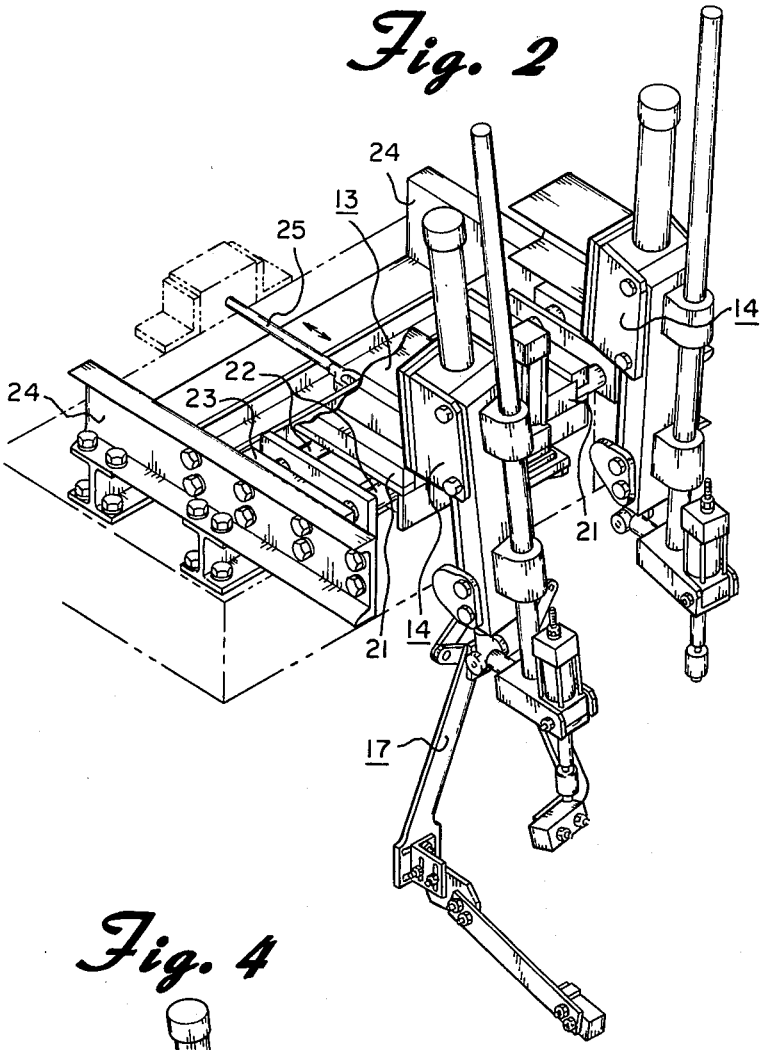
FIG. 2 is a perspective view of the carriage assembly and included welding gun assemblies and position sensing and control assemblies of the present invention.

The details of the carriage assembly 13 of the present invention are shown in FIG. 2 of the drawings. The carriage assembly includes a box frame 21 to which the two welding head assemblies 14 are attached. The box frame 21 is adapted to operate through a hydraulic ram (not shown) so as to move transversely upon two guide bars 22.

The entire box frame 21 and head assemblies mounted thereto are movable in dovetail guide blocks 23 mounted on side rails 24 at each side of the box frame 21. A carriage actuator means 25 which may be a hydraulic ram cylinder is attached to the box frame 21 and, upon command, moves the box frame 21 and associated stud welding assemblies in a longitudinal direction with respect to the rail and rail plate.

By reason of the foregoing construction, the carriage assembly 13 has the capability of moving the welding gun assemblies both transversely and longitudinally of the rail plate upon the application of the appropriate control pressure to the various hydraulic cylinders involved.

Figure 3:
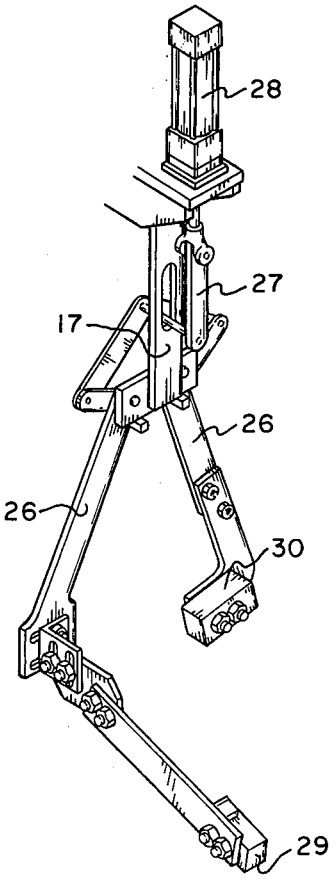
FIG. 3 is a perspective view of the position sensing and control assembly of the present invention.
Figure 5:
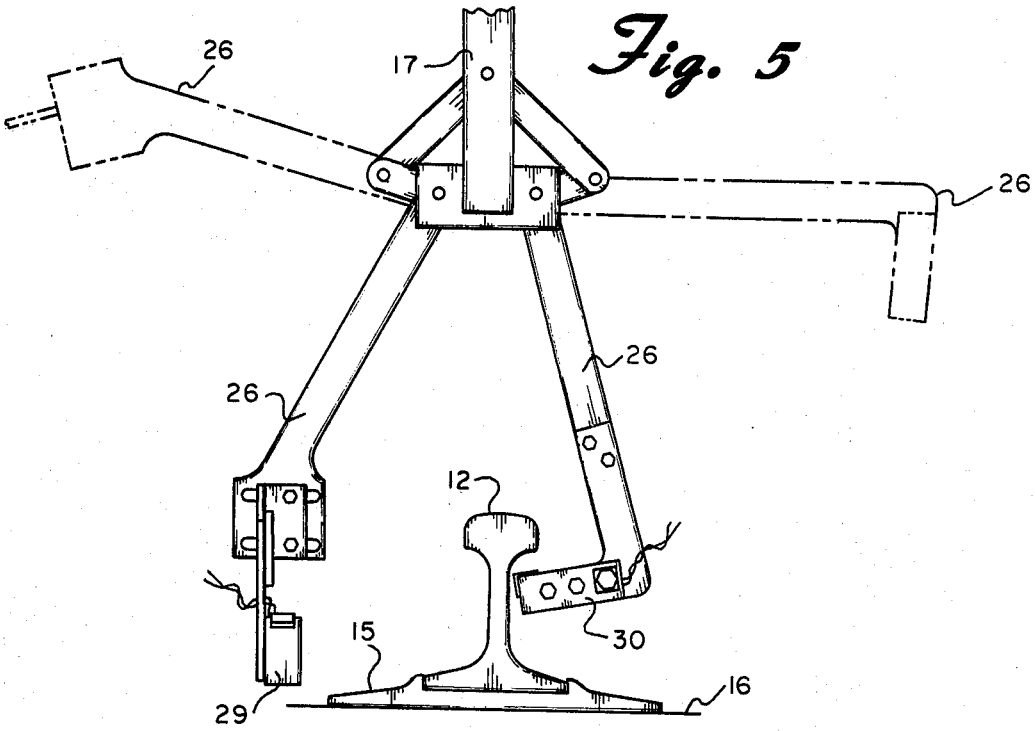
FIG. 5 is an end view of a portion of the position sensing and control assembly of the present invention.

A position sensing and control assembly 17 is secured to each carriage assembly and extends downwardly into the area of the rail plate and web of the rail as shown in FIGS. 2, 3 and 5. Referring to FIG. 3, the position sensing and control assembly 17 includes two sensor support arms 26. The sensor support arms are interconnected through a scissors assembly 27 to a hydraulic ram 28. The scissors assembly 27 operating through the hydraulic ram 28 permits the sensor support arms to be swung upwardly out of the way or downwardly into sensing position as shown in FIG. 5.

The sensor support arms 26 include a rail plate sensor 29 on one arm and a rail web sensor 30 on the opposite arm. The rail plate sensor and rail web sensor are electromagnetic devices which sense the proximity of the rail plate to the rail plate sensor and operate as will be hereinafter described.

Figure 4:
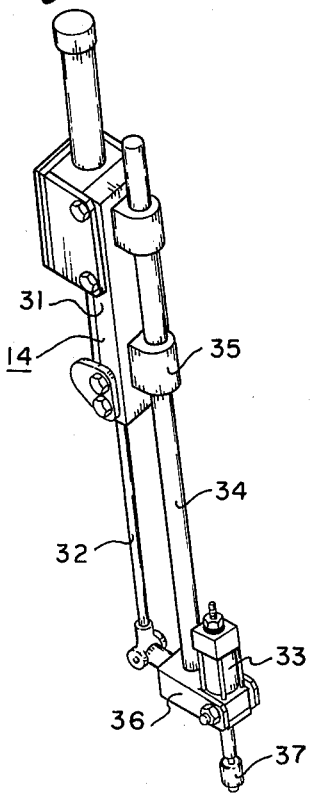
FIG. 4 is a perspective view of a welding gun assembly of the present invention.

A welding gun assembly 14, in accordance with the present invention, is shown in FIG. 4 of the drawings. The welding gun assembly includes a first ram assembly including a hydraulic cylinder 31 and associated piston rod 32. The first ram assembly also includes a guide rod 34 and associated guides 35 all of which terminate at a supporting block 36 which is moved upwardly and downwardly in accordance with the actuation of the first ram assembly.

A second ram assembly 33 is secured to the supporting block 36. The second ram assembly is designed such that it has a center position between the extremes of its travel to which the ram assembly normally assumes its beginning position. The piston travel upwardly from this datum plane and downwardly throughout the stroke of the piston within the ram assembly is set at predetermined limits of travel in the raised and lowered positions to control the lift and plunge of the stud to be welded as hereinafter described.

A stud chuck 37 is also provided at the lower extremity of the second ram assembly as shown in FIG. 4 of the drawings. Additionally, an arc shield retainer (not shown) is also provided at the lower extremity of the second ram and positioned in respect to the stud chuck by means of spring bias means such that the arc shield retainer may move relative to the second ram assembly and stud chuck so as the stud within the chuck can be exposed and permitted to contact the rail to which it is to be welded during the welding process for the purpose to be hereinafter discussed.

Figure 7:
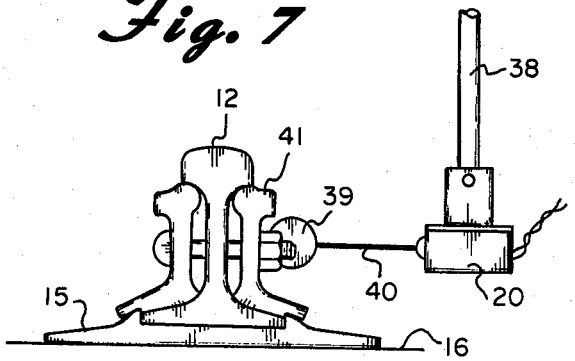
FIG. 7 is an end view of the lower portion of the obstruction sensor of the present invention.

Turning now to FIG. 7 of the drawings, the obstruction sensor 20 is shown. The obstruction sensor 20 is supported upon a long supporting rod 38 which is secured to the railway car assembly and may also be elevated upwardly manually to remove the obstruction sensor from the proximity of the railroad rail. However, in normal operating position, the supporting rod 38 is positioned such that the obstruction sensor 20 is adjacent the inner web of the rail.

The obstruction sensor includes a contact paddle 39 which operates through an arm 40 interconnected to the obstruction sensor 20. Upon the obstruction being contacted by the contact paddle 39, such as a railway spike projecting upwardly from the rail plate or the connecting bolts for an angle bar 41, the obstruction sensor will be switched to an activated position to deliver a signal indicating the occurrence of an obstruction. This signal, as described hereinafter, is utilized to stop the railway car assembly until the welding gun assemblies and position sensing and control assemblies can be manually retracted and moved to pass the obstruction.

In operation, the railway car assembly and associated equipment and hardware is propelled down the railway tracks at a high speed to the point where the welding operation is to begin. At that time, the operator of the device controls the railway car assembly from the console 18 seated at seat 19. The railway car assembly is then placed in low speed operation and moves along the rails at approximately two feet per minute.

At this time, the obstruction center 20 is lowered into its sensing position as shown in FIG. 7. At this time, the welding gun assemblies are in their retracted position as shown in FIG. 1 of the drawings and also the position sensing and control assembly is in retracted position as shown in FIG. 5 of the drawings.

As the first rail plate upon which studs are to be welded is approached, the position sensing and control assembly moves the rail plate sensor 29 and rail web sensor 30 into sensing position as shown in FIG. 5 of the drawings. The welding gun assembly control is programmed such that the carriage assemblies 13 will have the box frame 21 shifted to their furthest rightmost position at which the plate sensor 29 would be closest the rail web of the rail. This assures that the plate sensor 29 will pass above the leading edge of the rail plate. Additionally, this beginning configuration also maintains the rail web sensor 30 furthest from the rail web at the beginning of the sensing cycle.

One of the two carriage assemblies 13 and its associated position sensing and control assembly 17 is chosen as the master. For the purpose of discussion, assume that the master is the left-hand carriage assembly 13. The master carriage assembly is positioned midway of its longitudinal movement and locked in that position. The other carriage assembly is then programmed to have its box frame 21 moved to a rearward position by an approximate 6 inches. This predetermined backset is calculated to be the worst case condition for a railroad tie being out of perpendicular alignment with the rails and rail plates. Accordingly, the rail plate sensor 29 for the right-hand carriage assembly will always be trailing behind the left-hand sensor by an amount calculated to be the greatest displacement of the tie in a rearwardly direction.

As the railway car assembly moves forward, the rail plate sensor 29 of the left-hand carriage assembly 13 will sense the leading edge of the rail plate. As this occurs, a microprocessor controller 41, shown in FIG. 1, controlling the operation is programmed to stop the railway car assembly whereupon the welding gun assemblies of the left-hand carriage assembly are positioned midway of the rail plate. Such a condition is shown in FIG. 1 of the drawings.

At this time, the microprocessor then senses the condition of the rail plate sensor 29 of the right-hand carriage assembly. Under the preset conditions, the right-hand rail plate sensor will not have yet sensed the leading edge of the rail plate. The microprocessor then, operating through the welding gun control assembly, moves the carriage assembly 13 along a longitudinal direction to move the welding guns toward the rail plate until the rail plate sensor 29 senses the occurrence of the rail plate. When this occurs, the microprocessor further advances the carriage assembly longitudinally a predetermined distance to properly center the welding gun assemblies longitudinally with respect to the rail plate.

As previously stated, the worst case condition encountered in railroad ties is that of being approximately 4 inches forward or back of being perpendicular to the rails. Since the backset was 6 inches, the worst case condition of a railroad tie being off in a rearwardly direction is taken care of. The carriage assembly has at least an 8 inch travel in the longitudinal direction. Thus, the worst case forward situation of 4 inches may be compensated for by the carriage assembly moving through a perpendicular position to a 4 inches forward out of perpendicular alignment condition.

The next step in the sensing process is that both carriage assemblies, under control of the microprocessor, are moved to the left to bring the rail web sensor 30 toward the rail web as shown in FIG. 5. As each rail web sensor 30 reaches the proximity of the rail web, a signal is generated which, under the control of the microprocessor, stops that carriage assembly from any further movement to the left. At that point, the welding gun chucks and studs are properly positioned both longitudinally and transversely of the rail for proper welding.

Once the proper position has been achieved both longitudinally and transversely, the position sensing and control assembly 17 and its associated sensor support arms and sensors are swung upwardly out of the way as shown in FIG. 5. Thereupon, the welding gun assemblies operating through the first ram move the second ram and associated welding chuck and studs downwardly into contact with the rail plate as shown in FIG. 6. The spring loaded arc shield retainer permits the stud to move fully into contact with the rail plate.

Each welding gun assembly is energized until a predetermined pressure is generated in the welding gun's hydraulic cylinder. This pressure is sensed independently for each welding gun and, when achieved, the first ram assembly is locked into place to create a first datum plane. In this manner, variations in elevation of the rail plate from tie to tie is compensated for.

The microprocessor then controls the welding gun actuator to initiate welding current to each of the welding gun assemblies. This may be done simultaneously or sequentially depending upon the welding power supply. Upon a predetermined time relationship to the initiation of the welding gun current, the second ram assembly is actuated to raise the ram and its associated welding chuck and stud upwardly a predetermined position from the second datum plane established by the normal piston positioning of the second ram assembly discussed previously. As this occurs, an arc is drawn which produces melting in the heretofore normally known arc welding process.

After a predetermined time during the welding cycle, each second ram assembly is then energized in the opposite direction to move the piston therein to a predetermined position below the second datum plane to achieve plunge of the stud into the molten pool created during the welding process. At a predetermined time in the plunge, the welding current is turned off and the stud thus permitted to plunge into the molten pool and solidify completing the welding process.

At this point in the process, the welding gun assemblies are retracted clear of the rail plates and the studs welded thereon. Thereafter, the railway car assembly, under the control of the microprocessor, begins its slow travel toward the next railroad tie. During this interval, the operator then manually loads arc shields and studs to the welding gun assemblies.

The microprocessor controlling the system, after a predetermined time, then lowers the position sensing and control assembly support arms and sensors at a point midway between the cross ties and at a point where the position sensing and control assembly is free of the studs which have just been welded. Thereafter, the railway car assembly continues its travel toward the next rail plate at which the process is repeated upon sensing the leading edge of the left-hand rail plate.

At any time the obstruction sensor 20 senses an obstruction along the rail, the automatic process is interrupted and the railway car assembly stopped. At this time, the operator is able to visually observe the nature of the obstruction and to manually control the advancement of the railway car past the assembly and, if necessary, retract the position sensing and control assembly as necessary to clear the obstruction. The operation may then be returned to the automatic mode.

The foregoing invention has been described in respect to particular embodiments thereof as shown in the drawings and as generally described in the specification. It is to be understood that other variations and modifications of the invention will become apparent to those skilled in the art by reason of the foregoing disclosure thereof and, accordingly, no limitation was intended on the scope of the invention by the description thereof in reference to particular embodiments but the scope of invention is to be interpreted in view of the appended claims.

What is claimed is:

1. Mobile apparatus for on site welding of rail retaining clip studs to existing railroad rail plates comprising:

a railway car assembly including wheel and axle assemblies and propulsion means adapted to be positioned upon and traverse railroad rails;

a movable carriage assembly positioned in respect to each rail and including carriage actuator means for moving the carriage assembly both longitudinally and transversely of the rail within predetermined limits;

at least one welding gun assembly carried by each carriage assembly and extending therefrom into welding position above a tie plate; and position sensing and control means for sensing the rail plate position in respect to the welding gun assembly and for controlling the carriage actuator means to bring the welding gun assembly into proper position with respect to the tie plate.

2. The apparatus of claim 1 wherein the position sensing and control means includes a rail plate sensor for sensing the presence of a rail plate as the railway car assembly traverses the rails and to stop the car assembly at a predetermined position of the rail plate sensor with respect to the rail plate.

3. The apparatus of claim 2 wherein the position sensing and control means includes a rail web sensor which senses the position of the rail web sensor with respect to the railroad rail and to control the carriage actuator means to move the welding gun assembly transversely of the rail plate into proper welding position.

4. The apparatus of claim 3 wherein the tie plate sensor controls the carriage actuator means to move the welding gun assembly longitudinally of the rail plate into proper position.

5. The apparatus of claim 1 wherein two welding gun assemblies are provided for each carriage assembly for welding a stud to the rail plate on each side of each railroad rail.

6. The apparatus of claim 3 wherein the position sensing and control means further includes movable sensor support arms supporting the rail web sensor and rail plate sensor and adapted to move the rail web sensor and rail plate sensor between a first position ajdacent the rail plate and rail and a second position above the rail and rail plate.

7. The apparatus of claim 1 further including obstruction sensing means carried by the railway car assembly in advance of the carriage assembly and positioned adjacent the rail web to detect advancing rail obstructions and stop the rail car assembly.

8. The apparatus of claim 1 wherein the welding gun assembly includes stud chuck means, arc shield retaining means and first ram means to move the stud chuck means between a first raised position and a second welding position at which the stud is in engagement with the rail plate.

9. The apparatus of claim 8 further including welding gun assembly control means for locking the ram means in place upon the first ram means exerting a predetermined pressure upon the stud to establish a first datum plane.

10. The apparatus of claim 9 wherein the welding gun assembly further includes second ram means carrying the stud chuck means and arc shield retaining means wherein the second ram means includes a second datum plane and is movable between raised and lowered positions around the second datum plane to provide for stud lift and plunge.

11. The apparatus of claim 10 wherein the arc shield retaining means is spring loaded and movable with respect to the stud chuck to permit engagement of the stud with the rail plate.

12. The method of positioning and welding, on site, rail retaining clip studs to existing railroad rail plates comprising the steps of:

moving along the rails at a predetermined speed a railway car assembly including welding gun assemblies adapted to extend from the railway car assembly to the rail plates to weld studs thereupon and carried by a carriage assembly capable of moving the welding gun assembly in both transverse and longitudinal directions in respect to the rail plate;

sensing the approach of a rail plate and stopping the railway car assembly at a position wherein the stud is in longitudinal position in respect to the rail plate; and sensing the position of the stud in respect to the rail plate transverse to the rail plate and moving the carriage assembly to properly position the stud in respect to the rail plate.

13. The method of claim 12 further including the steps of moving the carriage longitudinally of the rail plate to position the stud with respect to the rail plate.

14. The method of welding a stud to a rail plate by means of a welding gun assembly including a first ram, a second ram carried by the first ram and carrying a welding gun chuck and an arc shield retainer including the steps of:

moving the first ram into welding position until the stud contacts the rail plate and a predetermined pressure has been exerted upon the stud;

locking the first ram in place upon reaching the predetermined level of pressure to establish a first datum plane;

positioning the second ram at a predetermined position to establish a second datum plane; and energizing the welding current through the stud while raising the second ram above the first datum plane and thereafter, plunging the ram to a position below the second datum plane to provide lift and plunge for the stud welding process.

15. The method of welding a stud according to claim 14 including the step of further providing the arc shield retaining means with spring resilient means relative to the stud to be welded to permit the stud to engage the rail plate.

* * * * *